United States Patent [19]

Tone

[11] Patent Number: 4,798,513

[45] Date of Patent: Jan. 17, 1989

[54] TURBINE CONTROL DEVICE

[75] Inventor: Youichi Tone, Tokyo, Japan

[73] Assignee: Kabushiki Kaisha Toshiba, Kanagawa, Japan

[21] Appl. No.: 91,026

[22] Filed: Aug. 31, 1987

[30] Foreign Application Priority Data

Sep. 9, 1986 [JP] Japan ..... 61-210750

[51] Int. Cl.[4] ..... F01D 17/06

[52] U.S. Cl. ..... 415/17; 364/160

[58] Field of Search ..... 415/17, 26, 27, 28, 415/30, 32, 39; 364/494, 160, 183

[56] References Cited

U.S. PATENT DOCUMENTS

| | | | |
|---|---|---|---|
| 3,816,715 | 6/1974 | Johnson | 364/160 |
| 3,906,196 | 9/1975 | Spitz | 364/160 |
| 4,533,990 | 8/1985 | Takada et al. | 364/160 |
| 4,603,394 | 7/1986 | Bukowski et al. | 415/17 |
| 4,656,589 | 4/1987 | Albers et al. | 415/17 |
| 4,687,410 | 8/1987 | Cline et al. | 415/17 |

*Primary Examiner*—Robert E. Garrett
*Assistant Examiner*—John T. Kwon
*Attorney, Agent, or Firm*—Foley & Lardner, Schwartz, Jeffery, Schwaab, Mack, Blumenthal & Evans

[57] ABSTRACT

A turbine control device which compensates for non-linearity of the degree-of-opening/flow-rate characteristic of a regulating valve. The device has a turbine rotation speed detector, a calculator to determine a desired flow rate based on a predetermined rotation speed and the detected speed, a valve for controlling the flow rate with a variable degree of opening, a flow rate detector, a memory unit for memorizing combinations of the detected flow rate and respective degrees of opening of the valve, a converter for converting the desired flow rate into a valve opening command signal based on the memorized combinations of the flow rate and respective degrees of opening of the valve, and a servo controller for the valve.

11 Claims, 4 Drawing Sheets

TURBINE CONTROL DEVICE

BACKGROUND OF THE INVENTION

1. Field of the Invention

This invention relates to a turbine control device which compensates for non-linearity of the degree-of-opening/flow-rate characteristic of a turbine regulating valve.

2. Description of the Prior Art

In general, the output of a steam turbine is regulated by using a regulating valve to alter the flow rate of the steam flowing into the turbine. However, the degree-of-opening/flow-rate characteristic of the regulating valve is normally non-linear, with a differential coefficient that is a maximum at the start of opening and which tends to drop as the valve gets closer to being fully open. The turbine control device is, therefore, usually provided with a function generator to compensate for this non-linearity. This will be described with reference to FIG. 1.

Inflow of steam generated in a boiler 10 into a turbine 12 is regulated by a regulating valve 14. The steam that flows into the turbine 12 rotates the turbine 12, driving a generator 16 and generating electric power.

The actual speed of the turbine 12 is detected by a speed detector 18. A deviation calculator 20 makes a comparative calculation with a speed value set by a speed/load setter 22. The deviation between this set speed and the actual speed is converted into a flow rate instruction by a speed controller 24 and sent to a function generator 26. Based on a preset function form, the function generator 26 converts the flow rate instruction into a valve degree-of-opening instruction, which is then sent to a servo controller 28. The servo controller 28 controls the degree of opening of the regulating valve 14 in accordance with this valve degree-of-opening instruction. Thus, the turbine 12 is controlled to a prescribed speed based on the degree of opening of the regulating valve 14.

In such a turbine control device, the function generated by the function generator 26 to compensate for the non-linearity of the degree-of-opening/flow-rate of the valve was conventionally set only with reference to the design data of the regulating valve. As a result, in many cases it would either overcompensate or undercompensate and it was difficult to obtain proper linearity. Furthermore, as this function generator was realized by a mechanical cam or electrical polygonal line function generator, resetting to adjust to operational data was difficult, and could only be carried out after shutting down the turbine. This wastes a lot of time and reduces the life of the turbine rotor.

SUMMARY OF THE INVENTION

One object of this invention is to provide a turbine control device including a function generator which easily and accurately compensates for non-linearity between the degree of opening of the regulating valve and the flow rate.

Another object of this invention is to provide a method of controlling a turbine, whereby non-linearity between the degree of opening of the regulating valve and the flow rate can be easily and accurately compensated.

According to one aspect of this invention, there is provided a device for controlling a turbine which is driven by a flowing fluid, the device comprising: means for determining a desired flow rate of the fluid; a valve for controlling the flow rate with a variable degree of opening; means for producing a signal indicative of a degree of opening of the valve; means for detecting flow rate and producing a signal indicative of the flow rate; means for sampling said degree of opening signal and said flow rate signal and memorizing a plurality of points, each indicative of a sampled detected flow rate and an actual degree of opening of the valve for producing the sampled detected flow rate; means for converting the desired flow rate into a valve degree of opening command signal based on the memorized point, and means for operating the valve according to the valve degree of opening command signal.

According to another aspect of this invention, there is provided a method of controlling a turbine which is driven by a flowing fluid, the method comprising steps of: determining a desired flow rate of the fluid; controlling the flow rate with a variable degree of opening of a valve; producing a signal indicating the degree of opening of the valve; detecting flow rate of the fluid and producing a signal indicating the flow rate; memorizing a plurality of points, each indicative of a sampled detected flow rate and actual degree of opening of the valve for producing the sampled detected flow rate; converting the calculated desired flow rate into a valve degree of opening command signal based on the memorized points; and operating the valve according to the valve degree of opening command signal.

Further objects, features and advantages of the present invention will become apparent from the detailed description of the preferred embodiments that follows, when considered with the attached drawings.

BRIEF DESCRIPTION OF THE DRAWINGS

The accompanying drawings, which are incorporated in and constitute a part of this specification, illustrate preferred embodiments of the invention and, together with the description, serve to explain the principles of the invention. In the drawings:

FIG. 4(*b*) is a graph showing the variation of the valve degree-of-opening instruction y with respect to the corresponding time shown in FIG. 4(*a*)

DETAILED DESCRIPTION OF THE PREFERRED EMBODIMENTS

Figure 1:
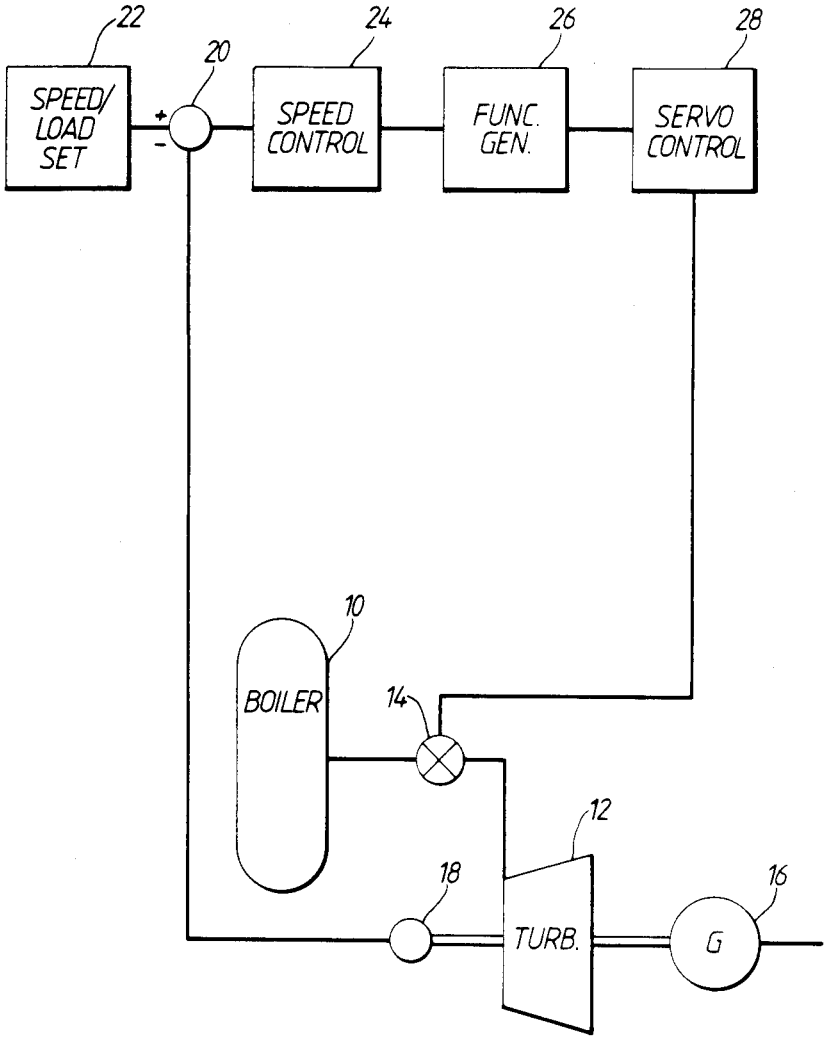
FIG. 1. (PRIOR ART)
FIG. 1 is a block diagram of a turbine control device of the prior art.
Figure 2:
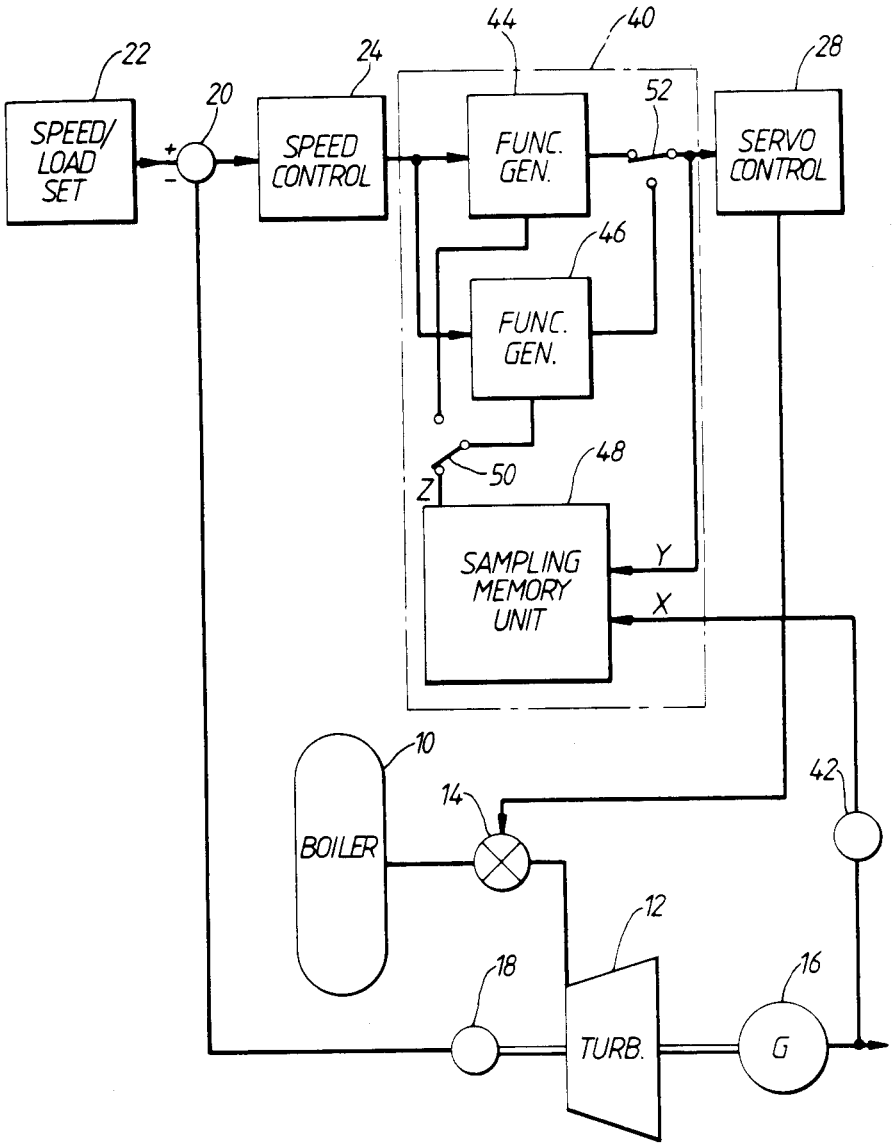
FIG. 2 is a block diagram of an embodiment of a turbine control device of this invention.

Referring to FIG. 2, parts which are the same as in FIG. 1 are indicated by the same numerals. A boiler 10 produces steam, and the steam is introduced to a turbine 12. The flow rate of the steam is controlled by a regulating valve 14. The steam that flows into the turbine 12 rotates the turbine 12, driving a generator 16 and generating electric power.

The actual speed of the turbine 12 is detected by a speed detector 18. A deviation calculator 20 makes a comparative calculation with a speed value set by a speed/load setter 22. The deviation between this set speed and the actual speed is converted into a flow rate instruction F by a speed controller 24 and sent to a function setter/generator unit 40. Based on a pre-set function, the function setter/generator unit 40 converts the flow rate instruction F into a valve degree-of-opening instruction signal y, which is then sent to a servo controller 28. The servo controller 28 controls the degree of opening of the regulating valve 14 in accordance with this valve degree-of-opening instruction. Thus, the turbine 12 is controlled to a prescribed speed based on the output of function setter/generator 40 controlling the degree of opening of the regulating valve 14.

A power detector 42 is arranged to detect the electric power produced by the generator 16 and produce a power signal X. The produced power is proportional to the steam flow rate. The function setter/generator unit 40 has a first function generator 44, a second function generator 46, a sampling memory unit 48, a first switch 50 and a second switch 52.

One of the two function generators, the first function generator 44 in the case of FIG. 2, is in an operational mode, and the other function generator, the second function generator 46 in the case of Fig. 2, is in a setting mode. The two function generators 44 and 46 are used alternately in the two modes, and are switched between modes using the two switches 50 and 52 on a periodic basis. Switches 50 and 52 may be manual switches which are held in the first position during initial acceleration of the turbine and then switched manually to the second position by an operator after the turbine has reached steady state operation.

The function generators 44 and 46 receive the flow rate instruction from the speed controller 24. With switches 50 and 52 in the positions shown in FIG. 2, only the function generator 44 is in the operational mode and gives the valve degree-of-opening instruction signal Y to the servo controller 28 via the second switch 52. The function generator 46 is in the setting mode and receives a plurality of combinations of points $z=(x, y)$ from the sampling memory unit 48 via the second switch 50, where x denotes the electric power signal from the detector 42 and y denotes the valve degree-of-opening instruction signal given to the servo controller 28. Based on the sampled values of x and y, the setting of function generator 46 is carried out.

Figure 3:
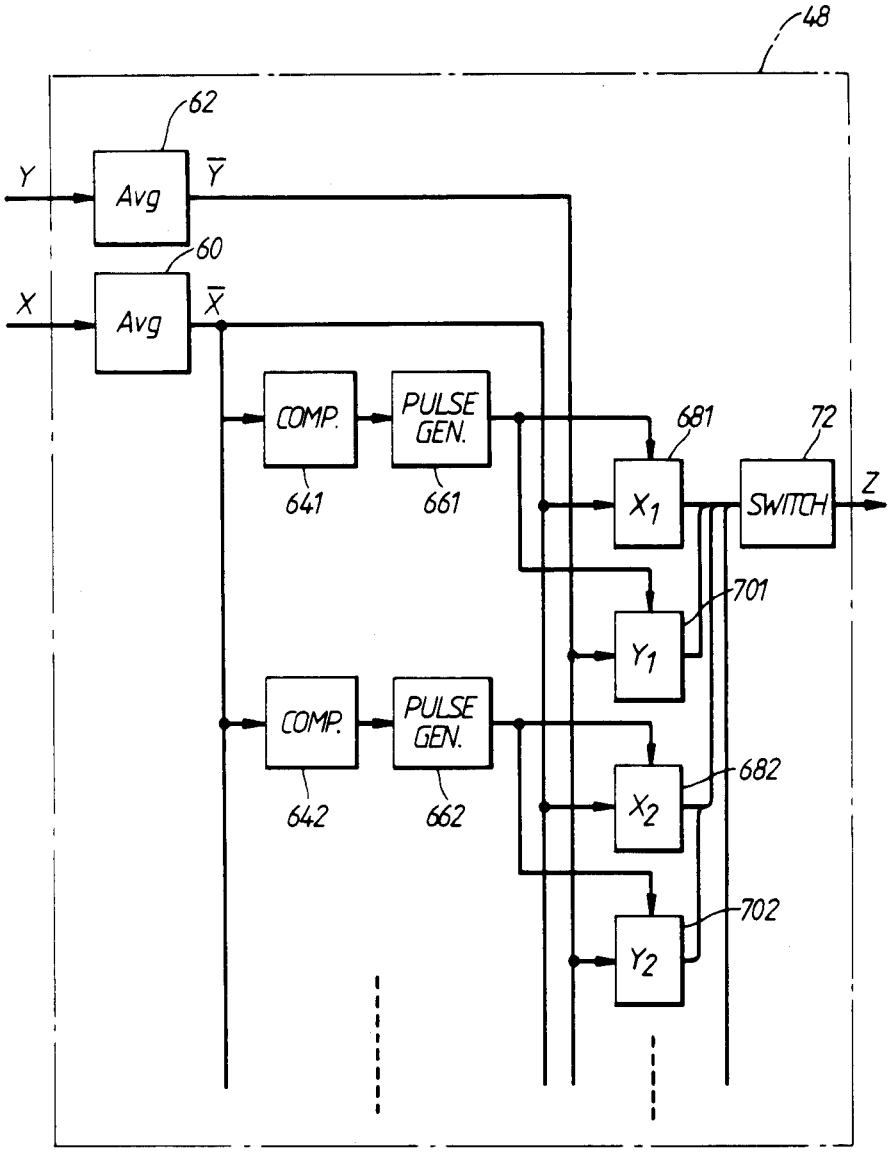
FIG. 3 is a detailed block diagram of the sampling memory unit shown in FIG. 2.

An embodiment of the sampling memory unit 48 will now be described referring to FIG. 3. A first averaging circuit 60 produces an average of the power signal x produced by the detector 42, and its output is denoted as a mean output $\overline{X}$. A second averaging circuit 62 produces an average of the valve degree-of-opening instruction signal y from the function generator 44 in the operational mode, and its output is denoted as a mean degree-of-opening instruction y. It should be understood that the degree-of-opening instruction signal $\overline{y}$ is being used here to indicate valve position. A signal from a sensor connected to the valve 14 to produce a signal indicating valve position could also be used.

The mean power signal $\overline{X}$ is sent to comparators 641,642, . . . , and compared with a plurality of comparators 641,642, . . . , where it is compared to preset power levels, as discussed below. The outputs of the comparators 641,642, . . . are sent, respectively, to one-shot pulse generators 661,662, . . . , where pulses are produced in response to the outputs of the comparators 641,642, . . . , respectively.

X-registers 681,682, . . . store, respectively, the sampled output values $x_1$, $x_2$, . . . of the first averaging circuit 60 at the times when the respective pulses are outputted. Y-registers 701,702,... store the valve opening degree instructions $y_1$, $y_2$, . . . , which are sampled output values of the second averaging circuit 62, at the times the respective pulses are output.

A changeover switch 72 is a multiplexer which sequentially transmits the output of the function set value combinations $(x_1, y_1)$, $(x_2, y_2)$, . . . to the function generator in the setting mode, the second function generator 46 in the case of FIG. 2.

The operation of the above device will now be described during a load increasing process when the preset values of the comparators 641, 642 and 643 are respectively set at P/3, 2P/3 and P where the rated power is denoted P.

On changeover of switches 50 and 52 to the position shown in FIG. 2, the first function generator 44 is in the operational mode, while the second function generator 46 is in the setting mode. During the process of a load increase, the actual turbine speed detected by the speed detector 18 is compared with the set value of speed/load setter 22, and the speed deviation is converted to a flow rate instruction by the speed controller 24. This flow rate instruction is converted to a valve degree-of-opening instruction signal y by the first function generator 44 and applied to the servo controller 28 which adjusts the degree-of-opening of the regulating valve 14. Thus the amount of steam supplied to the turbine 12 from the boiler 10 is adjusted so that the output of the generator 16 rises.

The output $\overline{x}$ detected by the power detector 42 and the corresponding averaged output $\overline{x}$ are thus increased from 0. When x reaches P/3, the comparator and the one-shot pulse generator 661 come into action, so that the mean generator output $x_1$ ($\sim$P/3) and the mean valve degree-of-opening instruction $y_1$ are sampled and stored in the registers 681 and 701 respectively to indicate the valve position required to give a flow rate proportional to P/3. Subsequently, at the time points $x_2 = 2P/3$ and $x_3 = P$, the mean generator outputs $x_2$ and $x_3$ and the mean valve degree-of-opening instruction signals $y_2$ and $y_3$ are likewise successively sampled and stored in the sequence of registers 682 and 702, 683 and 703, and so forth. For clarity, the sequence beyond registers 682 and 702 is not illustrated but would be obviously understood from FIG. 3 and the description thereof.

Figure 4A:
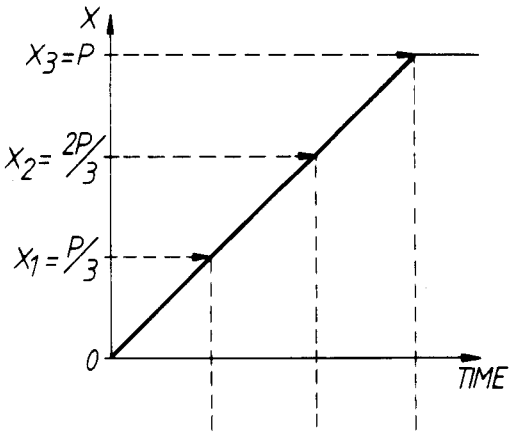
FIG. 4(*a*) is a graph showing the variation of the generator output x with respect to the time during a load increasing process.
Figure 4B:
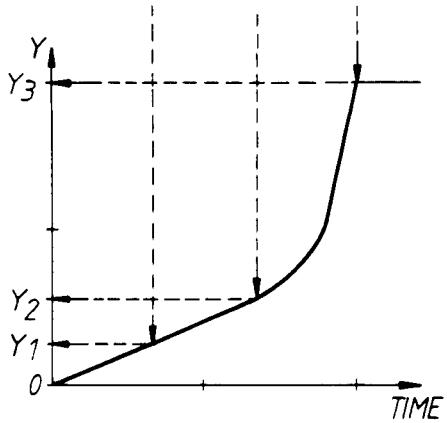

FIGS. 4(*a*) and 4(*b*) show an example of the progress of this operation taking the time axis as a reference, in which the generator output signal x is linear with respect to the time axis, and the valve degree-of-opening signal y is nonlinear. Therefore, for the generator outputs $x_1$, $x_2$, and $x_3$ at practically equal time intervals, the corresponding valve degree-of-opening instruction signals $y_1$, $y_2$, and $y_3$ at unequal intervals are obtained.

The multiplexer switch 72 successively transmits the respective function set values of the generator output signals x and the valve degree-of-opening instruction signal y stored in the respective registers 681, 682, . . . and 701, 702 . . . to be used in the function generator in the setting mode to generate a new function. Function generators, per se, are well-known and will not be discussed in detail here.

Figure 5:
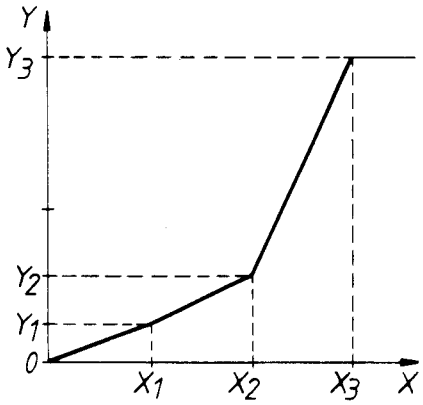
FIG. 5 is a graph of the valve degree-of-opening instruction y as the ordinate and the flow rate instruction x as the abscissa, showing how to set the function generator in the embodiment shown in FIG. 2, in accordance with the variations of x and y shown in FIGS. 4(*a*) and 4(*b*).

As shown in FIG. 5, a function curve with a change of gradient at three points can, therefore, be obtained by interpolating between the points $(x_1, y_1)$, $(x_2, y_2)$, . . . . obtained by correlating the generator output signal x, and the valve degree-of-opening instruction signal y. This curve is updated periodically and used by the function generators to produce a new valve degree-of-opening signal y.

After the process of turbine control by adjustment of the degree-of-opening of the regulating valve 14 while the load is being increased has been completed, the first and second switches 50 and 52 are changed over, so that the second function generator 46 is in the operational mode, and the first function generator 44 is in the setting mode. Thus, excellent turbine control can be achieved by accurate conversion from the flow rate instruction to the valve degree-of-opening instruction in accordance with the actual device operation.

Although in the above description, sampling using three points at equal intervals has been taken as an example, if required, sampling at unequal intervals or at a larger number of points can be performed by exactly the same technique. Furthermore, the method of obtaining a function from the sampled values obtained is of course not restricted to the linear interpolation method shown in this embodiment. A higher order function could be used to interpolate between these points.

In the above embodiment, the generator output is used as the signal corresponding to the flow rate. However, apart from this, exactly the same effect and advantages can be obtained by using other signals which are proportional or linear to the flow rate, such as the steam pressure of the first stage of the turbine, the reheated steam pressure, or a mean steam flow rate signal.

According to the above embodiments of this invention, accurate non-linear compensation can be carried out and correction of the entire function can easily be achieved all together by means of the sampling memory unit.

The foregoing description has been set forth merely to illustrate preferred embodiments of the invention and is not intended to be limiting. Since modification of the described embodiments incorporating the spirit and substance of the invention may occur to persons skilled in the art, the scope of the invention should be limited solely with respect to the appended claims and equivalents.

What is claimed is:

1. A device for controlling a turbine which is driven by a flowing fluid, the device comprising:

means for determining a desired flow rate of the fluid;

a valve for controlling the flow rate with a variable degree of opening;

means for producing a signal indicative of a degree of opening of the valve;

means for producing a signal indicative of flow rate;

means for sampling the degree of opening signal and the flow rate signal and memorizing a plurality of points each indicative of a sampled flow rate and an actual degree of opening of the valve for producing the sampled flow rate;

means for converting the desired flow rate into a valve degree of opening command signal based on the memorized points; and means for operating the valve according to the valve degree of opening command signal.

wherein the means for converting the desired flow rate into a valve degree of opening command signal comprises: first and second function generators each having an operational mode for converting the desired flow rate into the valve degree of opening command signal based on a present function and a presetting mode for presetting a function baed on the memorized points; and means for controlling one of said function generators to be in the operational mode and the other functional generator to be in the presetting mode, and switching over the first and second function generators between the operational mode and the presetting mode.

2. A device according to claim 1, wherein the means for producing signal indicative of flow rate detects electric power generated by the turbine as an indication of flow rate.

3. A device according to claim 1, wherein the means for memorizing comprises:

means for comparing the flow rate signal with a plurality of predetermined values; and means for storing the value of the flow rate signal and the value of the opening position signal at the times when the detected flow rate indication coincides with the predetermined values.

4. A device according to claim 1, wherein said degree of opening signal comprises the valve degree of opening command signal generated by the function generator in the operational mode.

5. A system for controlling a turbine driven by a flowing fluid, comprising:

means for determining the desired fluid flow rate;

a valve with a variable degree of opening for controlling the flow rate, the degree of opening having a non-linear relation to the flow rate;

means for producing a degree-of-opening signal having a linear relation to the degree-of-opening of the valve;

means for producing a flow rate signal having a linear relation to the flow rate of the fluid;

means for sampling the degree-of-opening signal and the corresponding flow-rate signals, and memorizing a plurality of points of the sampled degree-of-opening signal and their corresponding flow rate signals;

first and second function generators, each having both an operational mode for converting the desired flow rate into a degree-of-opening command signal based on a preset function and a presetting mode for presetting a function based on the interpolation of memorized points;

means for controllably switching the modes of each said function generator between its operational mode and its presetting mode so one generator is in the presetting mode while the other is in the operational mode; and means for operating the valve in accordance with said degree-of-opening command signal.

6. A device according to claim 5, wherein said means for producing a flow rate signal detects the electric power generated by said turbine as an indication of flow rate.

7. A device according to claim 5, wherein said sampling and memorizing means includes:

means for comparing the flow rate signal with a plurality of predetermined values; and means for storing the values of the flow rate signal and the values of the degree-of-opening signal at the times when the flow rate signal coincides with such predetermined values.

8. A device according to claim 5, wherein said degree-of-opening signal comprises a degree-of-opening command signal generated by the function generator in the operational mode.

9. A method of controlling a turbine which is driven by a flowing fluid, the method comprising the steps of:

determining a desired flow rate of the fluid;

controlling the flow rate with a variable degree of opening of a valve;

producing a signal indicating the degree of opening of the valve;

producing a signal indicative of flow rate;

sampling the flow rate signal and the degree of opening signal;

memorizing a plurality of points each indicative of a sampled detected flow rate and an actual degree of opening of the valve for producing the sampled detected flow rate;

converting the calculated desired flow rate into a valve degree of opening command signal based on the memorized points; and operating the valve according to the valve degree of opening command signal.

10. A method according to claim 9, wherein the step of converting the flow rate into the valve degree of opening command signal comprises the steps of:

converting the flow rate into the valve degree of opening command signal based on a preset function in a first function generator;

presetting a function in a second function generator based on the memorized points; and switching over the operations of the first and second function generators.

11. A method of controlling a turbine driven by a flowing fluid, comprising the steps of:

determining a desired fluid flow rate;

controlling the flow rate by means of a valve with a variable degree of opening, the degree of opening having a non-linear relation to the flow rate;

producing a degree-of-opening signal having a linear relation to the degree of opening of the valve;

producing a flow rate signal having a linear relation to the flow rate;

sampling the flow rate signals and the corresponding degree-of-opening signals;

memorizing a plurality of points each indicative of a sampled flow rate signal and corresponding actual degree-of-opening signal;

converting the flow rate signal into the degree-of-opening command signal based on a preset function in a first function generator in an operational mode;

presetting a fucntion in a second function generator based on the memorized points, the second function generator being in a presetting mode;

switching the operation modes of the first and second function generators; and operating said valve according to the degree-of-opening command signal.

* * * * *